US006896771B2

(12) United States Patent
Best et al.

(10) Patent No.: US 6,896,771 B2
(45) Date of Patent: May 24, 2005

(54) PAPER MACHINE CLOTHING AND A METHOD OF PRODUCING THE SAME

(75) Inventors: Walter Best, Duren (DE); Christian Molls, Aachen (DE)

(73) Assignee: Heimbach GmbH & Co., Duren (DE)

( * ) Notice: Subject to any disclaimer, the term of this patent is extended or adjusted under 35 U.S.C. 154(b) by 0 days.

(21) Appl. No.: 10/423,013

(22) Filed: Apr. 25, 2003

(65) Prior Publication Data

US 2004/0003861 A1 Jan. 8, 2004

(30) Foreign Application Priority Data

Apr. 25, 2002 (EP) ..... 02009446

(51) Int. Cl.[7] ..... D21F 7/12; D04H 3/04

(52) U.S. Cl. ..... 162/358.2; 162/360; 162/900; 34/116; 34/123; 156/309.9; 428/107; 428/109; 428/131; 428/193; 428/223; 428/347

(58) Field of Search ..... 162/306, 348, 162/358.2, 358.4, 900–904; 28/110, 142; 34/115–123; 139/383 A, 425 A, 383 AA; 428/105–114, 131–133, 190–193, 223, 343–354; 442/149–151, 263; 156/250, 272.2, 166, 290, 292, 296, 297, 299, 308.2, 309.6, 309.9

(56) References Cited

U.S. PATENT DOCUMENTS

| | | | | |
|---|---|---|---|---|
| 3,097,413 A | | 7/1963 | Draper, Jr. | |
| 3,164,514 A | * | 1/1965 | Day | 245/2 |
| 3,867,766 A | * | 2/1975 | Wagner | 34/95 |
| 4,142,557 A | * | 3/1979 | Kositzke | 139/425 A |
| 4,555,440 A | | 11/1985 | Crook | |
| 4,731,281 A | * | 3/1988 | Fleischer et al. | 428/196 |
| 5,077,116 A | * | 12/1991 | Lefkowitz | 428/141 |
| 5,628,876 A | * | 5/1997 | Ayers et al. | 162/358.2 |
| 5,888,915 A | * | 3/1999 | Denton et al. | 442/200 |
| 6,174,825 B1 | * | 1/2001 | Dutt | 442/43 |
| 6,576,091 B1 | * | 6/2003 | Cabell et al. | 162/348 |

FOREIGN PATENT DOCUMENTS

| | | |
|---|---|---|
| DE | 1802560 | 8/1969 |
| EP | 0394293 | 5/1994 |
| EP | 0947623 | 10/1999 |
| WO | WO 98/12370 | 3/1998 |
| WO | WO 99/16964 | 4/1999 |

* cited by examiner

*Primary Examiner*—Eric Hug
(74) *Attorney, Agent, or Firm*—Liniak, Berenato & White, LLC

(57) ABSTRACT

This invention relates to porous paper machine clothing (1, 11, 21) for de-watering a paper web in a paper machine, comprising a filament lay-up made of at least one layer (2, 12, 22) of longitudinal filaments (3, 13, 23) and at least one layer (4, 14, 24) of transverse filaments (5, 6, 7; 15; 25) which cross the longitudinal filaments (3, 13, 23), wherein the longitudinal and transverse filaments (3, 13, 23; 5, 6, 7; 15; 25) are single-component filaments, which is characterised in that the longitudinal and transverse filaments (3, 13, 23; 5, 6, 7; 15; 25) are fused at crossing points (8, 16, 27) to each other and/or to parts (17, 18, 19) joining them as a result of heating to the melting temperature which is restricted to said crossing points (8, 16, 27).

The invention further relates to a method of producing porous paper machine clothing such as this.

40 Claims, 4 Drawing Sheets

A
1
9
7
6
8
4
5
3
2

PAPER MACHINE CLOTHING AND A METHOD OF PRODUCING THE SAME

FIELD OF THE INVENTION

This invention relates to porous paper machine clothing for de-watering a paper web in a paper machine, particularly as a paper machine felt or drying screen, comprising a filament lay-up made of at least one layer of longitudinal filaments and at least one layer of transverse filaments which cross the longitudinal filaments, wherein the longitudinal and transverse filaments are single-component filaments.

BACKGROUND OF THE INVENTION

Porous paper machine clothing comprises long, wide belts which circulate in different parts of a paper machine and on which the paper web is conveyed through the paper machine. In the first part, which is termed the sheet forming section, a fibrous pulp is deposited on the paper machine clothing, whereupon a web of fibrous material is formed. This is dewatered through the paper machine clothing. The paper machine clothing consists of a textile filament product which is sufficiently porous for the liquid which originates from the web of fibrous material to be conveyed away through the paper machine clothing as a result of the effect of gravity and reduced pressure. In the subsequent press section, the paper web and the paper machine clothing are passed through roll presses so that the liquid which still remains in the paper web is pressed out through the paper machine clothing. In general, the paper machine clothing is formed as a felt comprising a support made of a textile filament product. In the subsequent drying section, the paper web and the paper machine clothing are passed over heated rolls, whereby further de-watering occurs—which is more precisely termed drying in this case. In the drying section, paper machine clothing which consists of filament-containing products is mainly used, i.e. as a drying screen, which is also porous, in order to convey the vapour away via the pores.

These textile filament products are mainly formed as woven fabrics. In addition, what are termed filament lay-ups are also known, in which the filaments are not bound to each other, i.e. they are not woven to or meshed with each other. U.S. Pat. No. 3,097,413 discloses paper machine clothing such as this. It has a filament lay-up comprising a layer of longitudinal filaments which extend parallel to and at a distance from each other, and which are not joined to each other. A fibrous felt, which surrounds the longitudinal filaments and which is needle-bonded thereto, is applied to this layer.

Paper machine clothing such as this only has a low transverse strength, however. A change has therefore been made to the use of a combination of a layer of longitudinal filaments with a layer of transverse filaments (DE-A-1 802 560; EP-B-0 394 293). In this procedure, modules consisting of a fibrous layer and of a fibrous web needle-bonded thereto are first formed, and these modules are combined and are needle-bonded again. This manner of production is not suitable for paper machine clothing which consists of one filament-containing product only. In this situation, U.S. Pat. No. 4,555,440 proposes that the individual filament layers be joined to each other by binding filaments.

In particular, in the aforementioned paper machine clothing of this type, the resistance to displacement between the individual layers, and thus the dimensional stability, is unsatisfactory. If binding filaments are used, they constitute extraneous bodies and significantly complicate the manufacturing process. In order to eliminate these disadvantages, U.S. Pat. No. 5,888,915 proposes that the layers of longitudinal and transverse filaments are laid directly on each other and are fused to each other by heating at their crossing points. The pre-requisite for this, however, is that two-component filaments are used in which the filament core has a higher melting temperature than the filament cladding. Fusion occurs by heating to a temperature above the melting point of the filament cladding and below the melting point of the filament core.

Due to the direct bonding of the filaments of the individual layers, the dimensional stability of the paper machine clothing is improved. One disadvantage, however, is that special filaments, namely two-component filaments, have to be used. These are expensive, and their material properties cannot always be adjusted in the optimum manner to suit the conditions in the respective part of the paper machine.

SUMMARY OF THE INVENTION

The underlying object of the present invention is to construct paper machine clothing comprising a filament lay-up so that it has a high dimensional stability and is suitable for all parts of a paper machine, despite the use of single-component filaments. A second object consists of providing a method of producing the same.

The first object is achieved according to the invention in that the longitudinal and transverse filaments are fused at crossing points to each other and/or to parts joining them as a result of heating which is restricted to said crossing points. The basic concept of the invention is therefore to heat the longitudinal and transverse filaments to their melting temperature, and thus to fuse them together, only at the crossing points where they are to be joined to each other. The temperature of the other regions of the filaments remains below the melting point of the filament material. Therefore, the latter does not undergo any change in structure or shape, so that as a whole the filament structure which is determined by the superposition of the layers is retained. Paper machine clothing which comprises a filament lay-up, and which is distinguished by its high dimensional stability and its low manufacturing costs due to the use of single-component filaments, is thus provided for the first time. Single-component filaments are to be understood to be filaments which homogeneously consist of one material, where the material can also be a copolymer, with the sole proviso that homogeneity is achieved.

Compared with knitted and woven fabrics, the paper machine clothing according to the invention has the advantage of a high degree of flexibility with regard to the number of layers, the filament density and the choice of material. Moreover, costly textile machines, such as weaving and knitting machines, are not necessary for manufacture. Furthermore, machines such as these restrict the width of paper machine clothing produced on them. Filament lay-ups are not subject to a restriction such as this, i.e. they can be produced in practically any width. Moreover, the thermo-fixing which is necessary for woven fabrics can be dispensed with if the filaments have previously been subjected to adequate thermal treatment.

Temporary fixing can also be effected by additionally positively attaching the longitudinal and transverse filaments to each other at crossing points. Each joint can consist of an aperture in one filament and of a projection, which fits suitably therein, on the crossing filament. The joint can also be formed, however, by the filaments having apertures which are mutually aligned at the crossing points, and through which a pin passes, e.g. a round bolt or a rivet made of plastics or metal. Moreover, a positive attachment such as this provides support for the fused joint between the filaments or between the apertures and projections or pins, and ensures even better fixing at the crossing points.

It is particularly preferred if the longitudinal and transverse filaments are formed as flat filaments with a rectangular cross-section. In this manner, surface contact occurs at the crossing points, and the area over which the filaments are fused to each other is considerably enlarged and is thus stronger. A range from 2 to 20 mm, preferably from 8 to 12 mm, has proved to be an advantageous width for the longitudinal and transverse filaments. The thickness should range between 0.3 and 2 mm, preferably between 0.6 and 1.2 mm, wherein the transverse filaments should have a thickness which as a maximum is the same as that of the longitudinal filaments.

In order to ensure sufficient permeability to water or vapour, particularly for very wide, flat filaments, passageway openings can be provided in the longitudinal and/or transverse filaments. The permeability can be controlled as desired by the size and number of the passageway openings, and it is also possible to arrange for the permeability to be different over the width of the paper machine clothing, e.g. for it to be higher in the middle than in the edge regions or vice versa. The passageway openings can be formed as round holes or as elongated slits.

The paper machine clothing according to the invention may comprise any number of layers, wherein each layer comprising longitudinal filaments alternates with a layer comprising transverse filaments, i.e. said layers are each adjacent to each other. An advantageous number of layers is two or three layers, wherein in the former case a lower longitudinal filament lay-up is preferably combined with an upper transverse filament lay-up, and in the latter case each layer comprising transverse filaments is surrounded on both sides by a layer of longitudinal filaments. In this manner, a longitudinal structure is formed on the upper and lower sides. It is also possible, of course, to employ the converse procedure, so that a transverse structure exists on the upper and lower sides due to the transverse filaments which are present there.

The permeability of the paper machine clothing can also be adjusted within wide limits by the width dimensions of the longitudinal and/or transverse filaments and/or by the filament density thereof, for example. It is also possible for the longitudinal filaments to be disposed in at least one layer so that in the middle region they have a filament density which is different from that in the edge regions, and so that in particular they have a density in the middle region which is less than that in the edge regions.

With the filament lay-up according to the invention, eyelets can also be formed in a simple manner on the end faces of the paper machine clothing by wrapping round longitudinal filaments with the formation of loops, in order to form an inserted wire joint therewith. This can be effected by wrapping the end pieces of longitudinal filaments of a first layer round the end faces of the paper machine clothing with the formation of loops on the side, which is remote from said layer, of the layer comprising transverse filaments, and fixing them to a plurality of said transverse filaments, preferably to at least five transverse filaments. The end pieces can also be fixed to the longitudinal filaments themselves however. In both cases, fixation can be effected positively, e.g. by means of pins or rivets made of plastics or metal.

Loop formation should advantageously be affected only with part of the longitudinal filaments, so that the loops of the two end edges fit into each other in the manner of combs and can thus form a passageway channel for an inserted wire. In an alternating manner, at least one end piece should preferably be wrapped round with the formation of a loop, and at least one end piece should end at the respective outer transverse filament edge without the formation of a loop. So that the permeability in this region is not impaired, longitudinal filaments from a second layer, which is seated against the layer comprising transverse filaments, should adjoin the ends of the end pieces, i.e. these longitudinal filaments should abut the end pieces flush therewith, but should not overlap them, so that there is no densification of longitudinal filaments in this region.

In principle, there are no limitations with regard to the material of the filaments, provided that the material is fusible and at the same time exhibits thermoplastic behaviour. Examples of suitable materials include PET, PA in all modifications, PPS, PEK, PEEK, elastic polyesters, PBT or PTT or combinations thereof. The filaments can also be reinforced, e.g. fibre-reinforced with glass fibres, carbon fibres and/or ceramic fibres, wherein the fibres can also be present as short chopped fibres.

The paper machine clothing according to the invention can be used in all parts of a paper machine, and due to its flexibility can be adapted in the optimum manner to the respective requirements in these parts. Constructions in which the paper machine clothing consists of a filament lay-up are particularly suitable for use in the sheet forming and drying sections. This does not rule out the combination of a filament lay-up with other components, for example with a fibrous felt. For the press section, it is recommended that the filament lay-up according to the invention is used as a support and is provided on one or both sides with a fibrous layer, for example by the needle-bonding or laminating of fibrous felts or spun felts to one or both sides, for example.

In order to produce the paper machine clothing described above, a method is proposed according to the invention in which the longitudinal and transverse filaments are fused at crossing points to each other and/or to parts joining them as a result of heating to the melting temperature which is restricted to said crossing points, wherein heating is effected by means of laser-, high-frequency- and/or induction energy. In this respect, two alternative procedures can be used, by means of which the heating can be concentrated at the crossing points. Firstly, energy can be applied in the form of spots, i.e. in a spatially restricted manner, to the crossing points, for which purpose lasers are particularly suitable due to their focussed laser beam. Alternatively, energy can also be applied two-dimensionally over a plurality of crossing points to be fused, for example over the entire width and over a defined length of the paper machine clothing, if the crossing points have previously been provided with an additive which promotes the absorption of energy. Due to said additive, energy absorption is concentrated at the crossing points, despite the two-dimensional application of energy, so that only the crossing points are heated to the melting temperature and consequently fuse to each other. Two-dimensional application of energy is simpler with regard to the requisite apparatus, since there is no need for focusing on to a multiplicity of crossing points to be joined.

The additive which is used in each case should be matched to the type of energy application. If a laser, for example a diode laser, is used, the additive should be a light-absorbing dye, e.g. black dye, or an optically active substance, wherein the layer above the additive should be transparent to the laser. Metal powders, particularly iron powder, which may be present in the form of a paste, a dispersion or a powder, is particularly suitable for the application of high-frequency or induction energy. The additive can be applied between the filaments or on the filaments, wherein in the latter case an application to the filaments of only one layer of two adjacent layers is sufficient. Instead of a subsequent application, the additive can also be added in the form of spots to the filament material, e.g. during an extrusion operation.

According to a further feature of the invention, provision is made for the longitudinal and transverse filaments firstly to be joined to each other at crossing points, using an adhesive and/or with a positive fit, before they are fused to each other. The joint at the crossing points is thereby further strengthened. Moreover, the position of the longitudinal and transverse filaments can be fixed by adhesive bonding and/or by positive attachment before the fusion operation, which is an advantage when the filament-containing product which is thus formed is moved through an apparatus by means of which thermal energy is applied.

In detail, the filament lay-up can be produced by firstly clamping longitudinal filaments parallel to each other, for example between two parallel filament beams, and then laying transverse filaments, individually or in groups, successively on said longitudinal filaments and temporarily fixing them to the longitudinal filaments, and by continuously conveying the filament lay-up longitudinally through a fusion apparatus and then rolling it up. At the same time or later, transverse filaments can also be fixed to the other side of the longitudinal filaments. It should be understood that a layer comprising longitudinal filaments can also be correspondingly applied again to the free side of the transverse filaments. Temporary fixing can be effected by the additional application of weight, for example with the aid of a plate which is transparent to the respective energy which is to be applied and which is laid on the transverse filaments, or by means of adhesive bonding.

Provision is also made according to the invention for the layers to be temporarily pressed on to each other after fusion at the crossing points until the joint has cured and cooled.

If a felt is to be formed, for example for use in the press section of a paper machine, a fibrous layer should be applied to one or both sides of the filament lay-up and fixed thereto. Fixing can be effected by means of needle-bonding, adhesive bonding, or contact fusion.

It should be understood that the transverse filaments do not have to extend perpendicularly to the longitudinal filaments, but that filament lay-ups can also be produced by the method according to the invention in which the transverse filaments extend obliquely to the longitudinal filaments. At the same time, two layers of transverse filaments can also be provided in which the transverse filaments of one layer cross the longitudinal filaments at a different angle to that of the other layer.

DESCRIPTION OF THE DRAWINGS

The invention is illustrated in more detail, with reference to examples of embodiments, in the drawings, where.

DETAILED DESCRIPTION OF THE PREFERRED EMBODIMENTS

Figures 1, 2, 3:
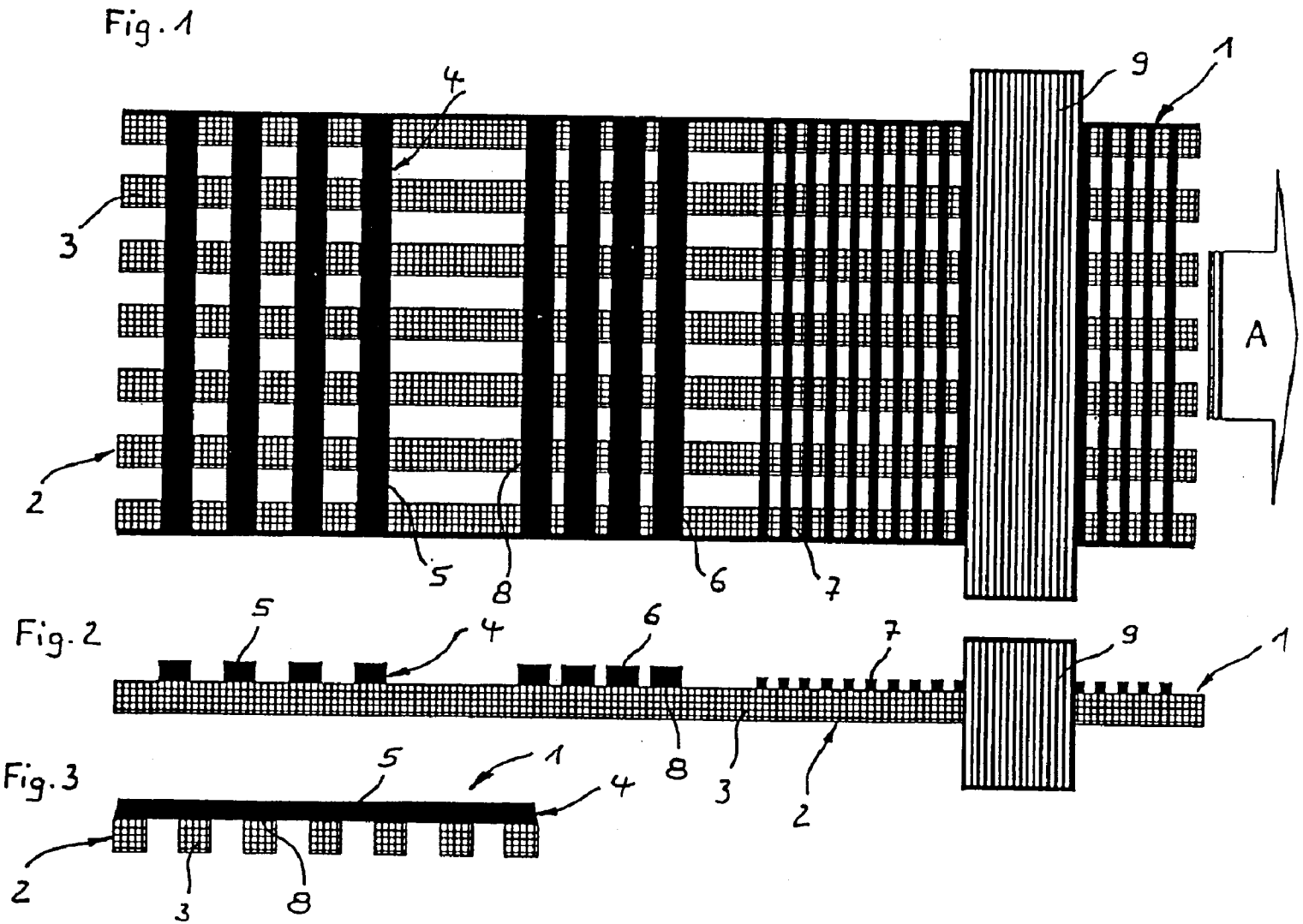
FIG. 1 is a schematic plan view of the paper machine clothing with a fusion apparatus.
FIG. 2 is a side view of the paper machine clothing shown in FIG. 1.
FIG. 3 is a cross-section through the paper machine clothing shown in FIGS. 1 and 2.

The paper machine clothing 1 illustrated in FIGS. 1 to 3 consists of a filament lay-up, the lower layer 2 of which is formed by longitudinal filaments—denoted by 3, for example. As can be seen in particular from FIG. 3, the longitudinal filaments 3 have a rectangular cross-section and are at identical spacings from each other. For the production process, the left-hand ends of the longitudinal filaments are wound on a filament beam, which is not shown here. A second beam, which is likewise not shown here, but on which the finished paper machine clothing 1 is wound up, is provided on the right-hand side. The paper machine clothing 1 is moved in this direction (arrow A).

An upper layer 4 comprising mutually parallel transverse filaments—denoted by 5, 6, 7, for example—is laid on the lower layer 2. The transverse filaments 5 are disposed at a wide spacing which substantially corresponds to the spacing between the longitudinal filaments 3, whilst the transverse filaments 6 are disposed at a narrow spacing for the purpose of reducing the permeability of the paper machine clothing 1, and the transverse filaments 7 are likewise disposed at a narrow spacing but have a width which is substantially less than that of the transverse filaments 5, 6. It should be understood that these differences are not present on actual paper machine clothing, i.e. identical transverse filaments are used at identical spacings from each other. The object of the illustration in the form shown here is to emphasise that the method according to the invention enables very different types of longitudinal and transverse filaments 3, 5, 6, 7 and filament densities to be employed. The same applies to the longitudinal filaments 3, wherein it is also possible here for the spacings thereof to be varied over the width thereof, e.g. to provide a filament density in the middle region which is less than that in the two end regions, or vice versa.

In order to produce the paper machine clothing 1 the longitudinal filaments 3 are clamped between the two beams, and the transverse filaments 5, 6, 7 are then laid over the longitudinal filaments 3. This can be effected by machine, using a transverse table apparatus such as that which is known in principle from U.S. Pat. No. 3,097,413 for example. So that the transverse filaments 5, 6, 7 also maintain their position in relation to each other and in relation to the longitudinal filaments 3 during the movement of the paper machine clothing in the direction of arrow A, they are temporarily adhesively bonded to each other at the crossing points—denoted by 8, for example—between longitudinal filaments 3 and transverse filaments 5, 6, 7. The adhesive can be applied to the longitudinal and/or transverse filaments 3, 5, 6, 7 as spots or two-dimensionally. Instead of fixation by adhesive bonding, a plate can also be laid on the upper layer 4, e.g. a glass plate which presses the transverse filaments 5, 6, 7 on to the longitudinal filaments 3 and thus prevents displacement between the two.

The paper machine clothing 1 is spanned by a fusion apparatus 9 in the form of a bridge. This apparatus is intended to fuse the material of the longitudinal and transverse filaments 3, 5, 6, 7 at the crossing points 8 so that they are fused to each other there. Laser-, high-frequency- and/or induction apparatuses are suitable as the fusion apparatus. So that fusion of the material of the longitudinal filaments 3 and transverse filaments 5, 6, 7 is restricted to the crossing points 8, an additive which promotes the absorption of the energy generated in the fusion apparatus 9 has been applied at the crossing points 8. The application of energy is then adjusted so that the longitudinal and transverse filaments 3, 5, 6, 7 only fuse, and consequently fuse to each other, at the crossing points, due to the additive which is present there, whilst the other parts of the longitudinal and transverse filaments 3, 5, 6, 7 are either not heated at all or are only heated slightly, and in any event are not heated to the melting temperature. After they leave the fusion apparatus 9, the crossing points 9 cool again, so that the fused regions harden and a strong joint is formed between the longitudinal and transverse filaments 3, 5, 6, 7. This can be further assisted by pressing the two layers together, for example with the aid of rollers or plates which are moved in conjunction with the movement of the paper machine clothing 1.

Figure 4:
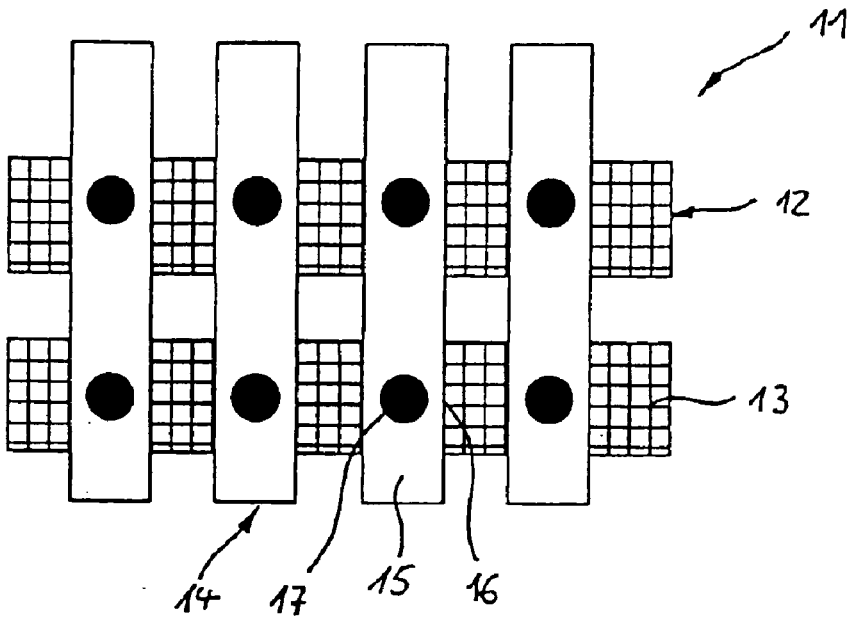
FIG. 4 is a plan view of part of a paper machine clothing with positive attachment of the filaments.
Figure 5:
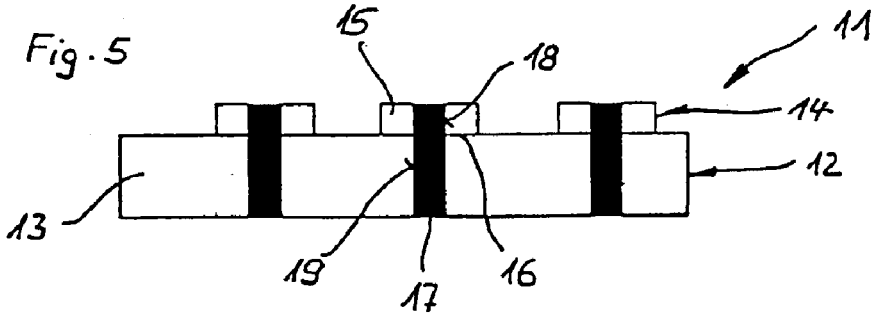
FIG. 5 is a partial cross-section through the paper machine clothing shown in FIG. 4.

FIGS. 4 and 5 show portions of different paper machine clothing 11 comprising a lower layer 12 made of longitudinal filaments—denoted by 13 for example—and an upper layer 14 made of transverse filaments—denoted by 15 for example. It should be understood that a multiplicity of a longitudinal filaments 13 is present, and that the transverse filaments 15 extend over the entire width of the paper machine clothing 11, which is not illustrated here.

The longitudinal and transverse filaments 13, 15 likewise have a rectangular cross-section here, wherein the transverse filaments 15 are flatter than the longitudinal filaments 13. At their crossing points—denoted by 16, for example—the longitudinal and transverse filaments 13, 15 are positively joined to each other via connecting pins—denoted by 17, for example—which each pass through mutually aligned holes—denoted by 18, 19, for example—in the longitudinal and transverse filaments 13, 15. Instead of this, however, the connecting pins 17 can also be integrally formed on the longitudinal filaments 13 or on the transverse filaments 15, so that only the respective other filaments comprise holes into which the connecting pins 17 are then pushed. The positive joint which is thus formed is of a temporary nature, in order to pass the filament lay-up through a fusion apparatus 9 of the type shown in FIG. 1 and in this manner to fuse together the longitudinal and transverse filaments 13, 15 and also to fuse them to the connecting pins 17.

Figure 6:
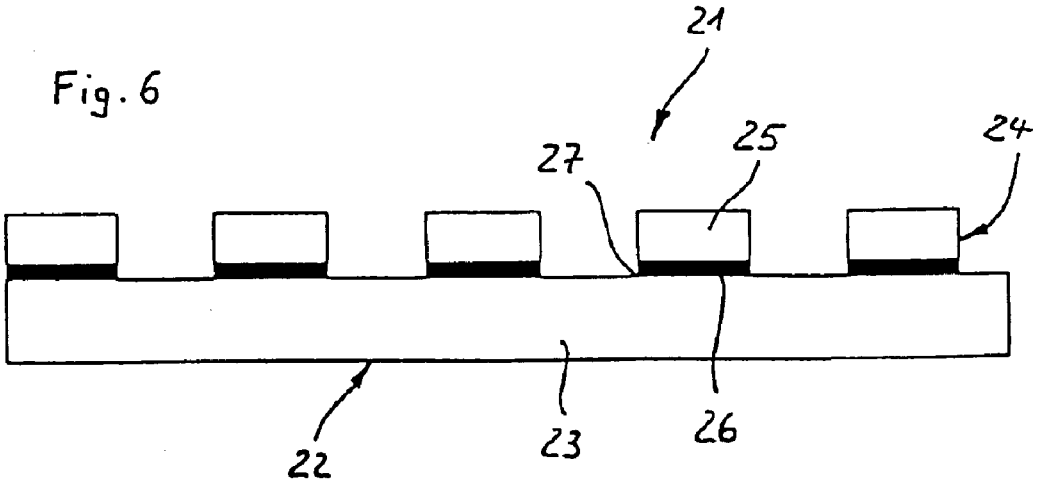
FIG. 6 is a side view of a further paper machine clothing.

FIG. 6 also illustrates a portion of a further paper machine clothing 21 comprising a lower layer 22 of longitudinal filaments 23 and an upper layer 24 of transverse filaments—denoted by 25 for example. The longitudinal and transverse filaments 23, 25 have a rectangular cross-section, so that they rest flat on each other. They are joined to each other at the crossing points 27 by layers of adhesive—denoted by 26 for example—so that they are mutually fixed in position. The joint is only provided temporarily in order to fix the longitudinal and transverse filaments 23, 25 for the conveying thereof through a fusion apparatus 9 of the type illustrated in FIG. 1. The longitudinal and transverse filaments 23, 25 are then fused together at the crossing points—denoted by 27 for example—in the fusion apparatus 9.

Figure 7:
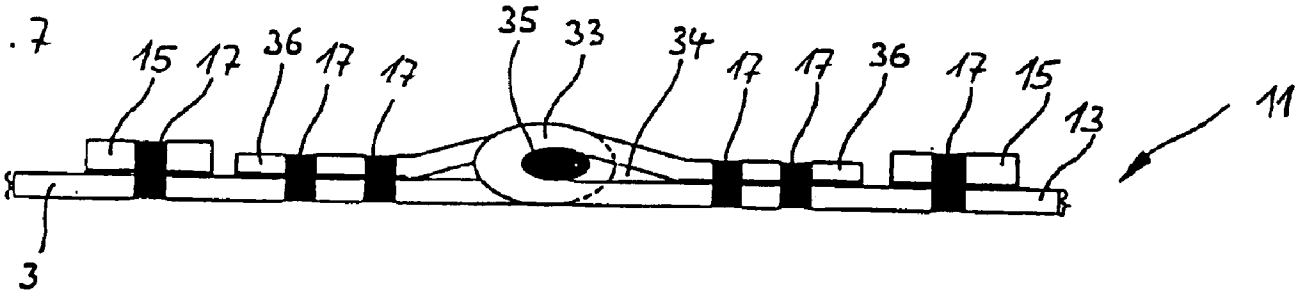
FIG. 7 is a side view of the seam region of the paper machine clothing according to FIGS. 1 through 3.
Figure 8:
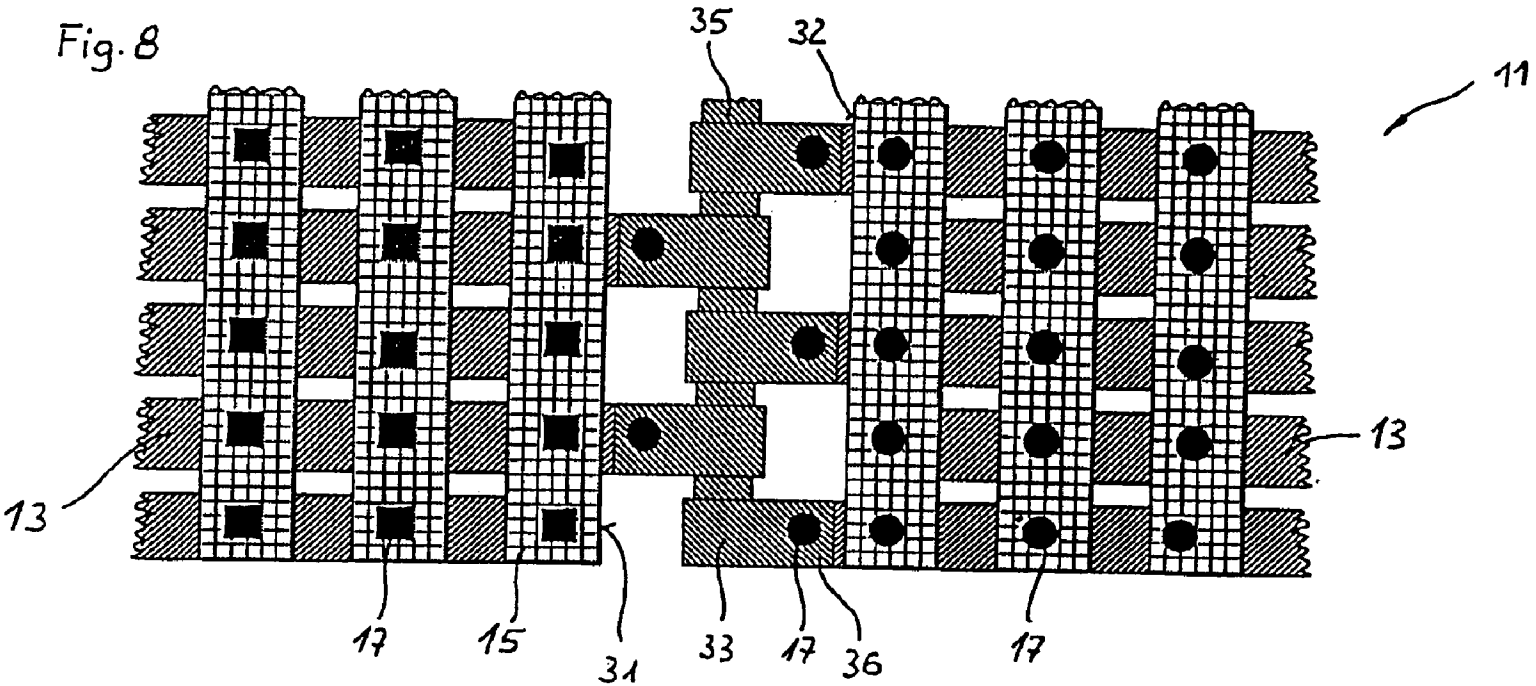
FIG. 8 is a plan view of the seam region of the paper machine clothing according to FIGS. 1 through 3.

In FIGS. 7 and 8, the end regions of paper machine clothing 11 are depicted partially, i.e. reduced in width to five longitudinal yarns 13. Transverse yarns 15 are connected via connecting studs 17 to longitudinal yarns 13; on the left side, connecting studs 17 that are square in cross section were used, and on the right side connecting studs 17 that are round in cross section. This depiction is provided solely in order to demonstrate that different cross sections can be used for connecting studs 17. Connecting studs 10 that all have the same cross-sectional shape will usually be used in a paper machine clothing 1.

At both ends 31, 32 of paper machine clothing 11, every second longitudinal yarn 13 protrudes in such a way that longitudinal yarns 13 of the two ends 31, 32 engage into one another in comb fashion, i.e. wherever a longitudinal yarn 3 projects at the one end 31, that longitudinal yarn 13 does not project at the other end 32, so that a gap is created for the portion of longitudinal yarn 13 projecting at end 31. The projecting portions of longitudinal yarns 13 are looped over and back to form loops (labeled 33 by way of example). They thereby form loop openings (labeled 34 by way of example) that all align with one another and thereby form a conduit through which a coupling wire 35 is inserted. This coupling wire 35 connects ends 31, 32 of paper machine 1, thus yielding an endless paper machine clothing 11. Paper machine clothing 11 can be opened again by pulling out coupling wire 35, for example in order to pull paper machine clothing 11 into a paper machine or remove it therefrom.

As is evident in particular from FIG. 7, the turned-over loop ends (labeled 36 by way of example) are laid back down onto the associated longitudinal yarn 13 and joined to it via connecting studs 17 in the same way that transverse yarns 5 are joined to longitudinal yarns 13. FIG.7 illustrates a connection of loop ends 36 using two connecting studs 17 in each case, but FIG. 8 illustrates the use of only one connecting stud 17. The variant according to FIG. 7 is suitable for transferring particularly large tensile forces.

Figures 9, 10, 11:
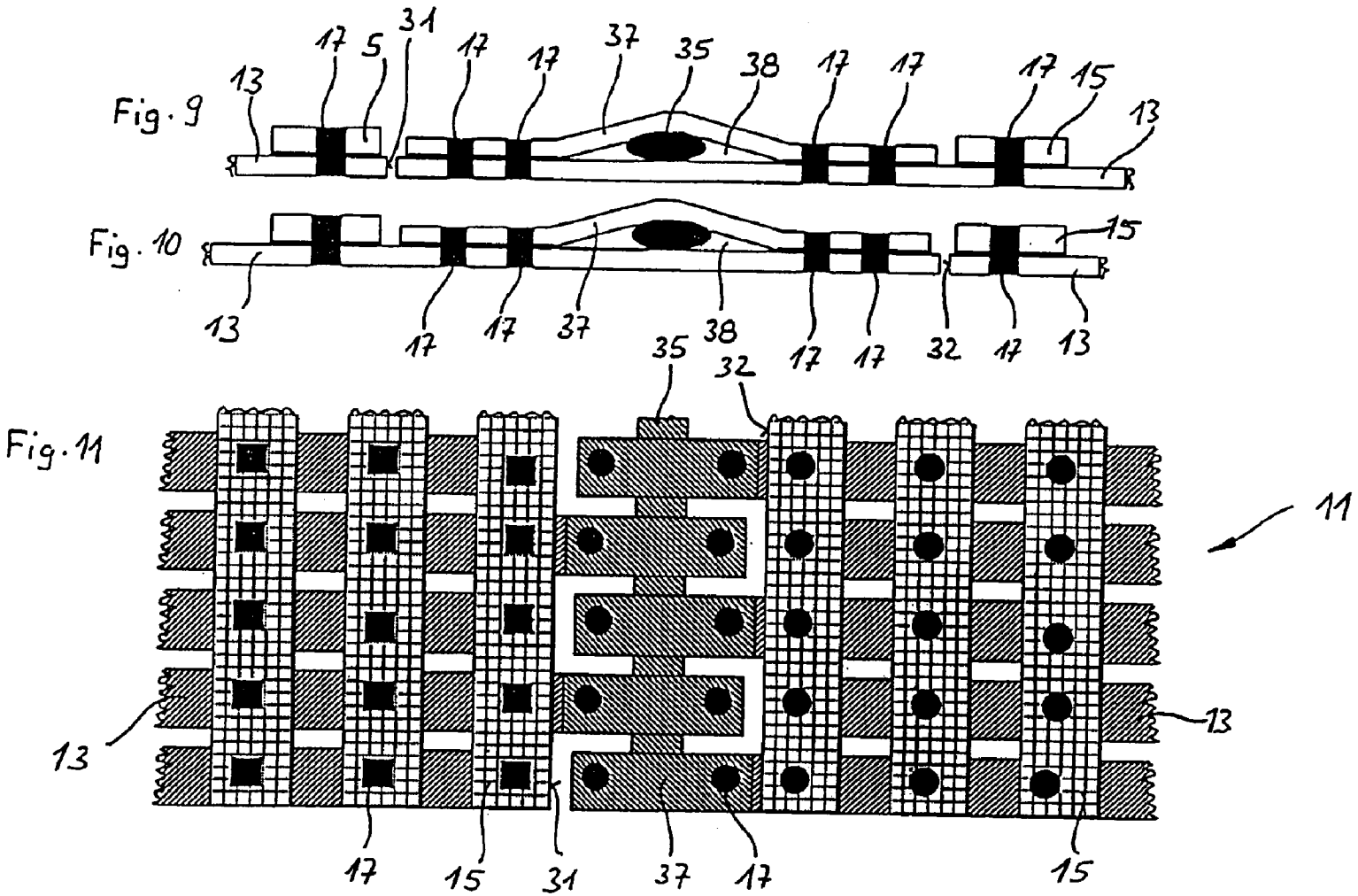
FIG. 9 is a longitudinal section through the seam region of the paper machine clothing according to FIGS. 1 through 3, showing the prolongation of a longitudinal yarn beyond the right end of the paper machine clothing.
FIG. 10 is a cross section through the seam region of the paper machine clothing according to FIGS. 1 through 3, showing the prolongation of a longitudinal yarn beyond the left end of the paper machine clothing according to FIGS. 1 through 3.
FIG. 11 is a plan view of the seam region of the paper machine clothing according to FIGS. 1 through 3, which differs from the embodiment of FIGS. 4 and 5.

In the exemplary embodiment according to FIGS. 9 through 11, paper machine clothing 11 has a form of connection of ends 31, 32 that differs from the embodiment according to FIGS. 7 and 8. Longitudinal yarns 13 are prolonged in the same way as in the embodiment according to FIGS. 7 and 8, i.e. they engage in comb fashion into one another. They are not, however, turned back to form loops; instead they extend out flat and end in the vicinity of transverse yarns 15 of the respective other end 31 or 32.

Yarn strips (labeled 37 by way of example) are laid onto the projecting portions of longitudinal yarns 13 in such a way that mutually aligning openings 38 are produced. Coupling wire 35 is inserted through these openings 38. On either side of coupling wire 35, yarn strips 37 are connected to the projecting portions of longitudinal yarns 13 by means of connecting studs 17. In the variant shown in FIGS. 6 and 7, four connecting studs 17—two on either side of coupling wire 35—are used for this in each case, so that large loads can be handled. If the loads are smaller, two connecting studs 17—one on either side of coupling wire 35—are sufficient in each case, as depicted in FIG. 11.

What is claimed is:

1. A porous drying screen for a drying section of a paper machine, comprising:

a filament lay-up comprised of at least one layer of longitudinal, single-component thermoplastic filaments and at least one layer of transverse, single-component thermoplastic filaments, said transverse filaments crossing said longitudinal filaments at crossing points, said longitudinal filaments fused to said transverse filaments solely at said crossing points.

2. The drying screen of claim 1, wherein said longitudinal and transverse filaments are additionally positively attached to each other at said crossing points.

3. The drying screen of claim 2, wherein each crossing point consists of an aperture in one filament and a projection in the corresponding filament, which fits suitably therein, at said crossing point.

4. The drying screen of claim 2, wherein each crossing point consists of mutually aligned apertures in said filaments and pins which pass through said apertures.

5. The drying screen of claim 1, wherein said longitudinal and transverse filaments are formed as flat filaments with a rectangular cross-section.

6. The drying screen of claim 5, wherein said longitudinal and transverse filaments have a width of between about 2 mm and about 20 mm.

7. The drying screen of claim 6, wherein said longitudinal and transverse filaments have a width of between about 8 mm and about 12 mm.

8. The drying screen of claim 1, wherein said longitudinal filaments have a width in their middle region which differs from that in their edge regions.

9. The drying screen of claim 5, wherein said longitudinal and transverse filaments have a height of between about 0.3 mm and about 2 mm.

10. The drying screen of claim 9, wherein said longitudinal and transverse filaments have a height of between about 0.6 mm and about 1.2 mm.

11. The drying screen of claim 5, wherein said transverse filaments have a thickness that is no greater than the thickness of said longitudinal filaments.

12. The drying screen of claim 1, wherein at least one of said longitudinal and transverse filaments comprises passageway openings.

13. The drying screen of claim 1, wherein the screen has at least three layers, and said layer of longitudinal filaments is adjacent said layer of transverse filaments.

14. The drying screen of claim 13, wherein said layer of transverse filaments is sandwiched between first and second layers of said longitudinal filaments.

15. The drying screen of claim 1, wherein at least one of said layers of longitudinal filaments has a filament density in its middle region which differs from that in its edge regions.

16. The drying screen of claim 1, wherein at least some of said longitudinal filaments include end portions that loop back to form loop openings, said end portions are fixed to an end face of paper machine clothing.

17. The drying screen of claim 16, wherein at least some of said end portions of said longitudinal filaments are fixed to said transverse filaments.

18. The drying screen of claim 1, wherein end portions of at least some of said longitudinal filaments are fixed to end portions of other of said longitudinal filaments.

19. The drying screen of claim 16, wherein at least some of said end portions of said longitudinal filaments do not form said loop openings, and each of said non-loop forming end portions are fixed to a last transverse filament on the end face of the paper machine clothing.

20. The drying screen of claim 16, wherein at least one of said end portions of said longitudinal filaments is wrapped around to form a loop, and at least one of said end portions terminates at an outer edge of a last transverse filament on the end face of the paper machine clothing.

21. The drying screen of claim 16, wherein a second layer of said longitudinal filaments is seated against said layer of transverse filaments, said second layer adjoining said end portions.

22. The drying screen of claim 1, wherein at least one of said longitudinal and transverse filaments are formed from a material selected from the group consisting of PET, PA in all modifications, PPS, PEK, PEEK, an elastic polyester, PBT, PTT, and combinations thereof.

23. The drying screen of claim 1, wherein at least one of said longitudinal and transverse filaments are fibre-reinforced.

24. The drying screen of claim 1, further comprising a fibrous layer disposed on at least one side.

25. A method of producing porous drying screens for a drying section of a paper machine, comprising the steps of:

providing at least one layer of thermoplastic longitudinal filaments;

disposing at least one layer of thermoplastic transverse filaments onto the longitudinal filaments and arranging the transverse filaments to contact the longitudinal filaments at crossing points;

heating to the melting point the longitudinal and transverse filaments solely at the crossing points and thereby fusing the longitudinal and transverse filaments at the crossing points.

26. The method of claim 25, wherein one of laser, high-frequency, and induction energy is used during said heating step.

27. The method of claim 26, wherein the energy is applied in the form of spots.

28. The method of claim 26, wherein the energy is applied two-dimensionally over a plurality of crossing points.

29. The method of claim 26, including the step of providing an additive at the crossing points which facilitates the absorption of energy.

30. The method of claim 29, wherein the additive is selected from the group consisting of a dye, an optically active substance, and a metal powder.

31. The method of claim 29, wherein the additive is only applied to one filament lay-up.

32. The method of claim 25, including the further step of positively attaching the longitudinal and transverse filaments to each other at the crossing points prior to said heating step.

33. The method of claim 25, including the step of arranging the longitudinal filaments parallel to each other prior to said disposing step.

34. The method of claim 33, wherein the transverse filaments are laid, individually or in groups, successively on the longitudinal filaments and temporarily fixed to the longitudinal filaments during said disposing and arranging step.

35. The method of claim 34, wherein the filaments are conveyed in a longitudinal direction through a fusing apparatus during said heating step and then rolled up.

36. The method of claim 25, wherein the layer of longitudinal filaments is disposed between a bottom layer of transverse filaments and a top layer of transverse filaments during said disposing step.

37. The method of claim 34, wherein temporary fixing is effected by an application of weight.

38. The method of claim 34, wherein temporary fixing is effected by adhesive bonding.

39. The method of claim 25, wherein the longitudinal and transverse filaments are temporarily pressed together at the crossing points prior to fusing.

40. The method of claim 25, wherein a fibrous layer is applied to at least one side of the filaments and is fixed thereto.

* * * * *